US005736954A

United States Patent [19]

Veazey

[11] Patent Number: 5,736,954

[45] Date of Patent: Apr. 7, 1998

[54] PARAFOIL-BORNE DISTRESS SIGNALS

[75] Inventor: Sidney E. Veazey, King George, Va.

[73] Assignee: S E Ventures, Inc., King George, Va.

[21] Appl. No.: 610,368

[22] Filed: Mar. 4, 1996

Related U.S. Application Data

[62] Division of Ser. No. 129,770, Sep. 30, 1993, Pat. No. 5,530,445.

[51] Int. Cl.[6] ..... H01Q 15/00; B63C 9/08

[52] U.S. Cl. ..... 342/8; 342/10; 441/89

[58] Field of Search ..... 441/89; 342/8, 342/9, 10

[56] References Cited

U.S. PATENT DOCUMENTS

| | | | |
|---|---|---|---|
| 3,217,325 | 11/1965 | Mullin | 342/10 |
| 3,224,001 | 12/1965 | Rudnofsky et al. | 342/10 |
| 3,749,337 | 7/1973 | Jalbert | 244/145 |
| 4,017,908 | 4/1977 | Murnane | 441/89 |
| 4,149,304 | 4/1979 | Brynjegard | 29/148.4 |
| 4,178,867 | 12/1979 | Shyu | 114/39 |
| 4,497,272 | 2/1985 | Veazey | 114/103 |
| 4,553,037 | 11/1985 | Veazey | 290/55 |
| 4,598,661 | 7/1986 | Roe | 116/209 |
| 4,729,530 | 3/1988 | Jalbert | 244/152 |
| 4,768,739 | 9/1988 | Schnee | 244/146 |
| 5,174,529 | 12/1992 | Jalbert | 244/145 |
| 5,326,297 | 7/1994 | Loughlin | 441/89 |

OTHER PUBLICATIONS

U.S. Coast Guard—"Getting Help on the Water", pamphlet, COMDTPUB P-6101.3.

46.CFR 160.072—"Distress Signals for Boats, Orange Flag" (1979).

S. E. Veazey & Prov. M. Saarlas, Rept. EW-11-83, "Mastless Sails" (1982) U.S. Naval Academy Div. of Engineering & Weapons (esp. pp. 2, 14, 17).

*Primary Examiner*—J. Woodrow Eldred

*Attorney, Agent, or Firm*—James K. Poole

[57] ABSTRACT

Distress signal kits comprise a parafoil for carrying aloft various emergency or distress signals such as radar reflective materials, lights, flares, distress flags or smoke signals. Preferably the parafoil itself is colored International orange and contains a U.S. Coast Guard-approved distress signal (BLACK SQUARE AND CIRCLE) on both top and bottom surfaces. The parafoil can be used to raise a spinnaker sail attached to a vessel or swimmer. The spinnaker can also carry radar reflective components and/or distress flags, and can be fitted for other survival uses.

16 Claims, 14 Drawing Sheets

PARAFOIL-BORNE DISTRESS SIGNALS

This application is a division of application Ser. No. 08/129,770, filed Sep. 30, 1993, now U.S. Pat. No. 5,530,445.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates to distress or emergency signalling devices, for use on sea or land, which are lifted into the air by lighter-than-air balloons, sails, or particularly by means including a parafoil such as used by sport parachutists.

2. Description of the Prior Art

Increasingly popular among outdoor sports are boating, hiking, cross-country skiing and the like. One factor such sports have in common is the possibility of participants becoming lost or other distress situations which require signalling the outside world for help and perhaps employing survival techniques while awaiting rescue. For example, the U.S. Coast Guard provides various recommendations and requirements for recreational boats or other vessels operating in coastal waters or the high seas. A variety of signals may be used for day and/or night signalling. Pyrotechnic visual distress signals include pyrotechnic red flares, hand-held or aerial; orange smokes, hand-held or floating; and launchers for aerial red meteors or parachute flares. Non-pyrotechnic visual distress signals include orange distress flags and electric distress lights. The distress flag, for day use only, must be at least three feet square, containing a black square and ball (circle) on an orange background. The electric distress light for night use can be a signal light flashing SOS signals or (under Inland Navigation Rules) a high intensity white light flashing 50–70 times per minute (i.e., a "strobe light").

With any of the signals described, mariners (or hikers, etc.) in distress encounter limitations in how long the signals (such as rockets or flares) persist and how far they can be seen (determined primarily by the size and altitude of the distress signal). Applicant has previously explored possibilities for raising distress signals to higher altitudes using devices such as the Jalbert parafoil used by sport parachutists. A parafoil is defined as a flexible structure made of lightweight fabric or the like, having a shape similar to that of an airplane wing (or airfoil) which can be used as a kite or parachute. Such parafoils are now available commercially in sizes ranging from those suitable for sport parachuting down to those which are effectively toy kites. Applicant's U.S. Pat. No. 4,497,272 discloses and claims "Mastless Sails", i.e., various combinations of parafoils, balloons and sails (such as a spinnaker) which can be used to provide extra propulsion to small boats or the like. Also, U.S. Pat. No. 4,178,867 cited therein discloses the use of a hydrogen-filled signal balloon to hold a rescue signal device aloft. Applicant's patent suggests (in col. 4) that visual recognition of such parafoil/spinnaker combinations can be enhanced by coloring them international orange. Communications means such as omnidirectional antennas can be used on such sails.

Despite the availability of a variety of Coast Guard-approved distress signals, there is growing demand for signals which may be more effective, convenient and useful, preferably qualifying for Coast Guard certification.

SUMMARY OF THE INVENTION

An object of the present invention is to provide distress signals useful for day and/or night use from sea or land which are more effective due to improved visibility and yet are convenient and economical to use. A further object is to obtain increased range for the visibility of such distress signals by providing means to increase their altitude. Another object is to provide convenient, compact and economical means for recreational boaters and others to easily carry such distress signals. Still another object is to provide a rugged lift device for distress signals and the like which operates effectively even after punctures or other damage.

These and other objects and advantages of the present invention will be apparent to those skilled in the art upon perusing the following detailed description, including the drawings, specification and appended claims.

According to the present invention, these and other objects can be achieved by providing an aerial distress signal kit comprising a parafoil colored international orange which bears a distress signal consisting essentially of a black square and circle on the upper and lower surfaces thereof, with a bridle and line attached thereto for flying same. The parafoil can comprise radar reflective material, and in a preferred embodiment incorporates a radar reflector having three mutually orthogonal surfaces of radar reflective material. The parafoil is preferably large enough to be certified as a distress flag by the U.S. Coast Guard, and can carry a radar reflective tail. The line for flying the parafoil can carry a number of further distress signals, including radar reflective strips, battery-powered strobe lights, flares, smoke signals and radar reflectors. Radio antennas can also be carried. In a preferred embodiment, an additional distress flag is suspended from the parafoil line by a triangular connector which allows the flag to hang substantially vertically.

A preferred form of the radar reflector is a folding version which comprises three round discs which interlock in a mutually orthogonal manner. Applicant has developed a collapsible inflatable version of such a reflector in which the discs comprise inflatable hoops having thin, flexible radar reflective material stretched therein, the hoops mutually intersecting each other to provide three orthogonal surfaces and an interconnecting air cavity which can be inflated from a single inlet. The resulting inflatable reflector can be encased in a large elastic, radar-permeable balloon which protects it both before and after inflation (the outer balloon being inflated so as to shield the reflector and hold the components rigidly in place).

To carry the distress signals to higher altitudes, provide larger visual and radar signals and provide propulsion to watercraft, a spinnaker sail of suitable size can be raised by the parafoil and thereafter controlled by suitable control lines as illustrated in Applicant's U.S. Pat. No. 4,497,272, which is incorporated herein by reference. The spinnaker can be connected to the parafoil by control lines as shown, or directly to the parafoil by any suitable means. The spinnaker can itself incorporate a large USCG-approved distress flag, and offers considerably more propulsion power as well as lift for raising the distress signals aloft. Further utility can be incorporated in the spinnaker sail by making it of a lightweight, light-reflecting and radar reflective material and fitting it with fastening means to facilitate use as a personal blanket, poncho or sleeping bag when not being flown. Suitable fabrication materials include metallized polymeric films (such as aluminized Mylar) and fabrics such as polyesters and the like. Light reflection is obtained by using reflective coatings of metal, metal paint, or the like.

These various distress signal kit components can be packed conveniently for mariners in a life jacket having suitable compartments or pockets, preferably also comprising a survival hood and a radar reflective hood and/or inflatable panel which folds into the jacket's collar. In a preferred embodiment, the parafoil is contained in folded form within a survival hat (preferably orange in color) which forms a drawstring bag for storage in the lifejacket pocket. The hat can have connections for fastening a strobe light and/or radar reflector to the top thereof. The lifejacket can also contain at least one folding or collapsible rod which can be used to facilitate launching the parafoil and/or to mount a radio antenna or signal light on the life jacket, thus raising the antenna or light above the water surface.

DETAILED DESCRIPTION OF THE INVENTION

Figure 1:
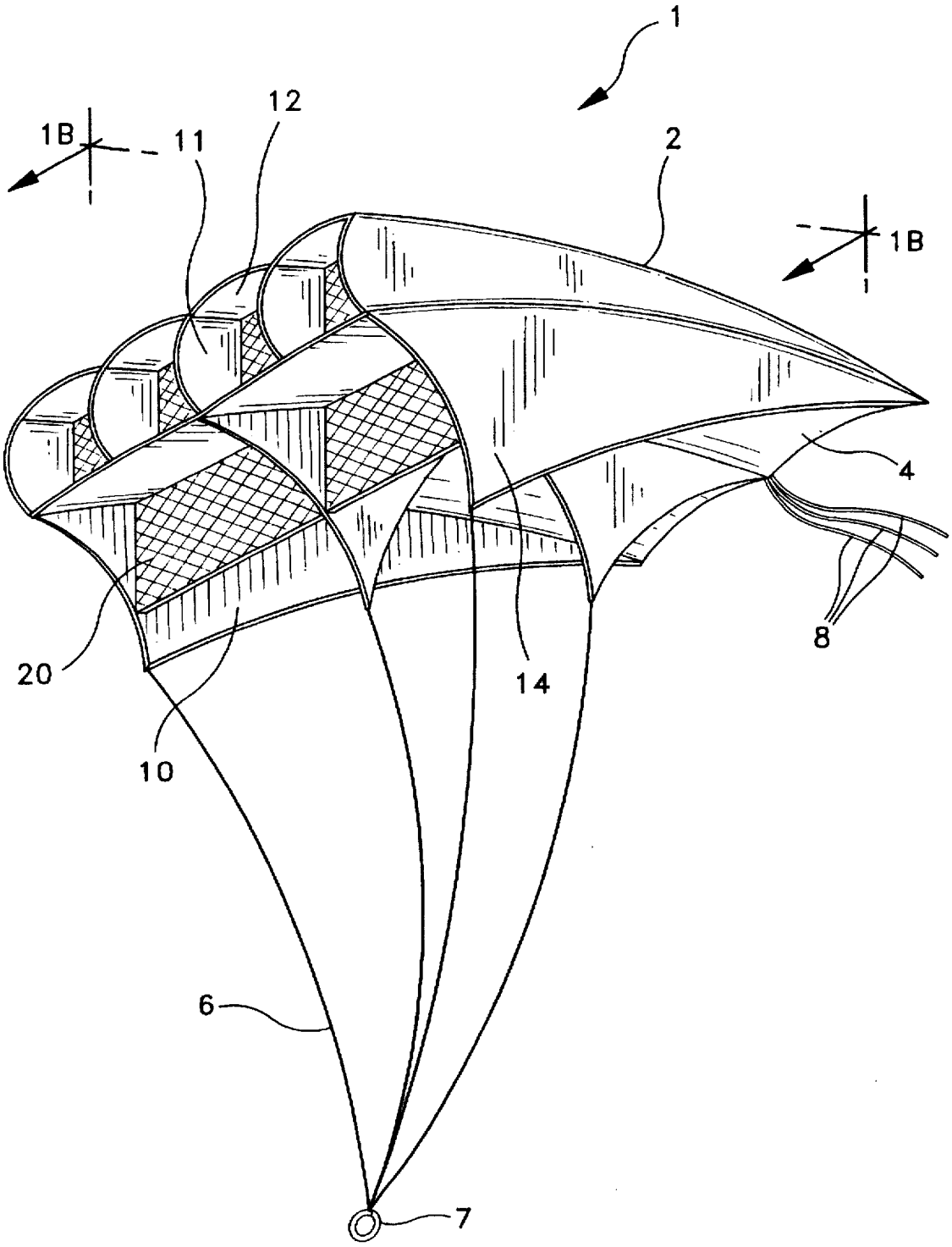
FIG. 1 shows a Jalbert parafoil in flight. A radar reflector having orthogonal reflecting surfaces is incorporated in the parafoil structure, as shown in FIGS. 1A and 1B. A Coast Guard-authorized distress signal (black square and circle) is displayed on the upper and lower surfaces of the parafoil canopy, as shown in FIG. 1C.

As should be apparent from the above summary of the invention, the various embodiments of the invention form an integrated system or series of kits for assembling a variety of distress signal devices offering greater altitude and thus greater range of visibility. Turning now to the drawings, FIG. 1 shows a typical Jalbert parafoil (1) in flight. The upper and lower surfaces thereof (i.e., top (2) and bottom (4) canopies) are those directed towards the sky and earth, respectively, in flight. Such parafoils are described in Applicant's U.S. Pat. No. 4,497,272. The forward end of the parafoil is that to which the bridle (6) is attached, and the rear end is that to which the optional tail (8) is attached. As shown, top and bottom canopies are intersected by side (10) and interior (11) panels which define a plurality of open cells (12) which can take in ram air when facing upwind and inflate the parafoil structure. Sewn to the bottom of the parafoil are a plurality of ventral or guide vanes (14). The bridle is customarily attached to the bottoms of these guide vanes, and ring 7 is connected to the parafoil line (not shown here). Larger parafoils may have more than four cells and three ventral vanes as shown here.

Figure 1A:
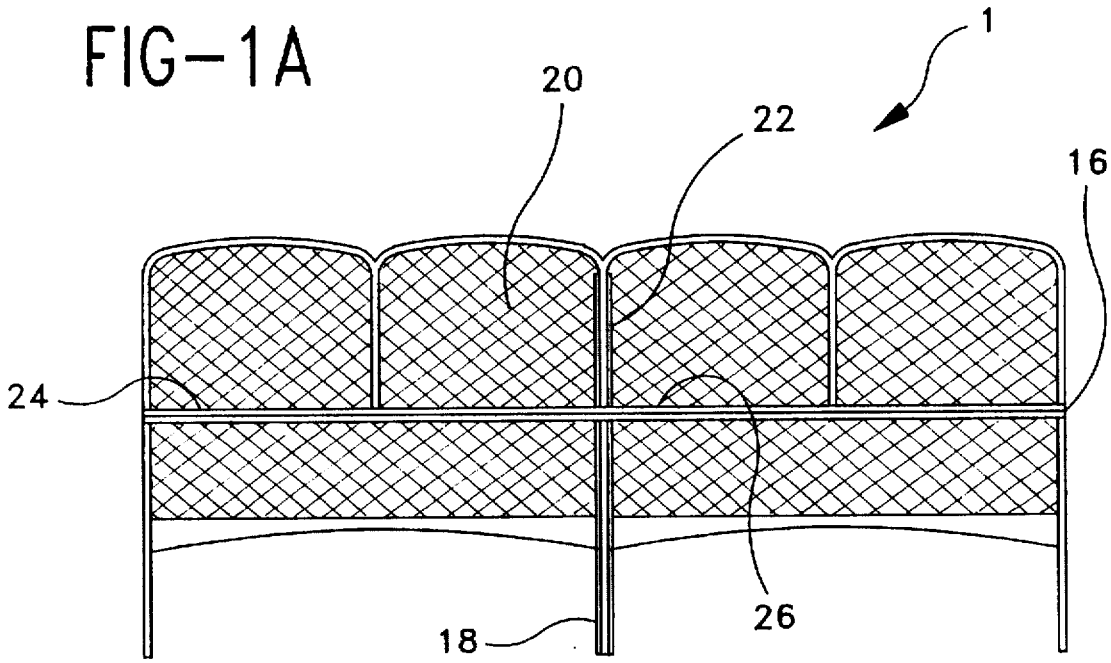
Figure 1B:
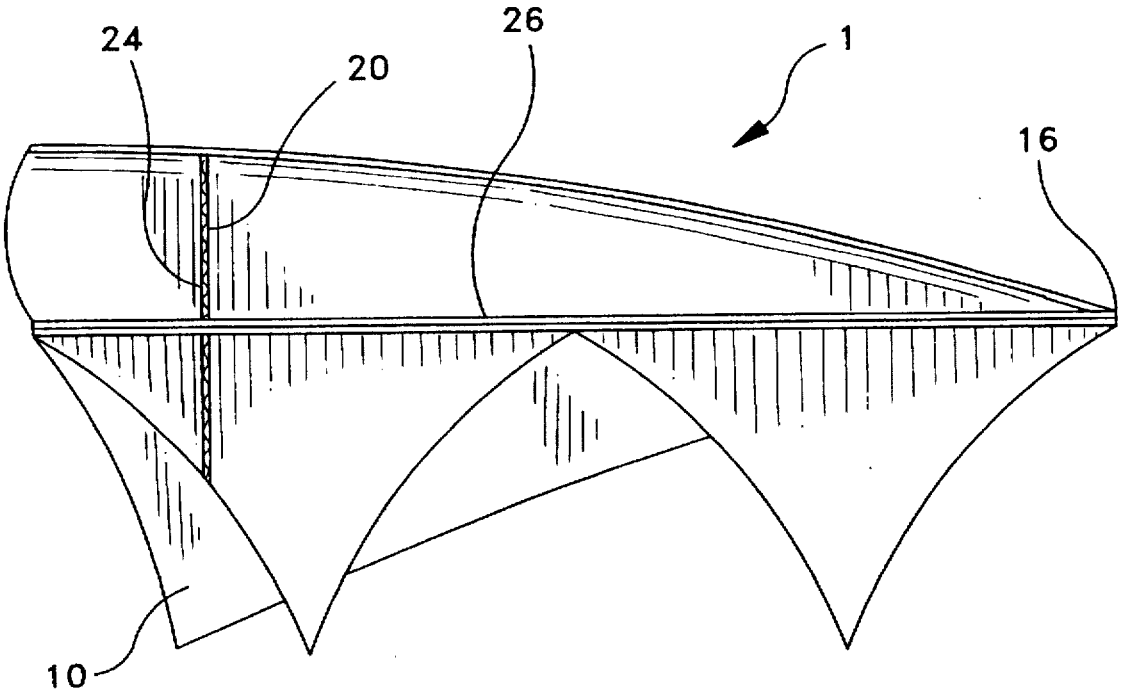

Radar-reflective material can be incorporated in the parafoil to make it an effective radar target, and Applicant has found that optimum results are obtained when radar reflective materials (e.g., aluminized Mylar) are included in the natural structural features of the parafoil so as to form three mutually orthogonal planes. The remaining surfaces and components of the parafoil are made of nylon, polyester or other radar-permeable fabrics or films. This configuration provides for omnidirectional retroreflection of radar waves; in other words, radar waves striking the parafoil from any azimuth will be reflected back to the source. An example of such construction can be seen in FIGS. 1A and 1B, where radar-reflective material such as aluminized Mylar has been inserted in a horizontal plane (16) (part of the lower canopy) and a vertical plane (18) dividing the parafoil longitudinally, normally the central septum between the cells and the central ventral. To provide the required orthogonal radar-reflective surface without significantly impeding the flow of air through the cells, a metallized mesh material is used in vertical plane (20) which is perpendicular to the longitudinal axis and can also be seen in FIG. 1. The intersections of these orthogonal radar reflective planes are shown as lines (22), (24), and (26).

Figure 1C:
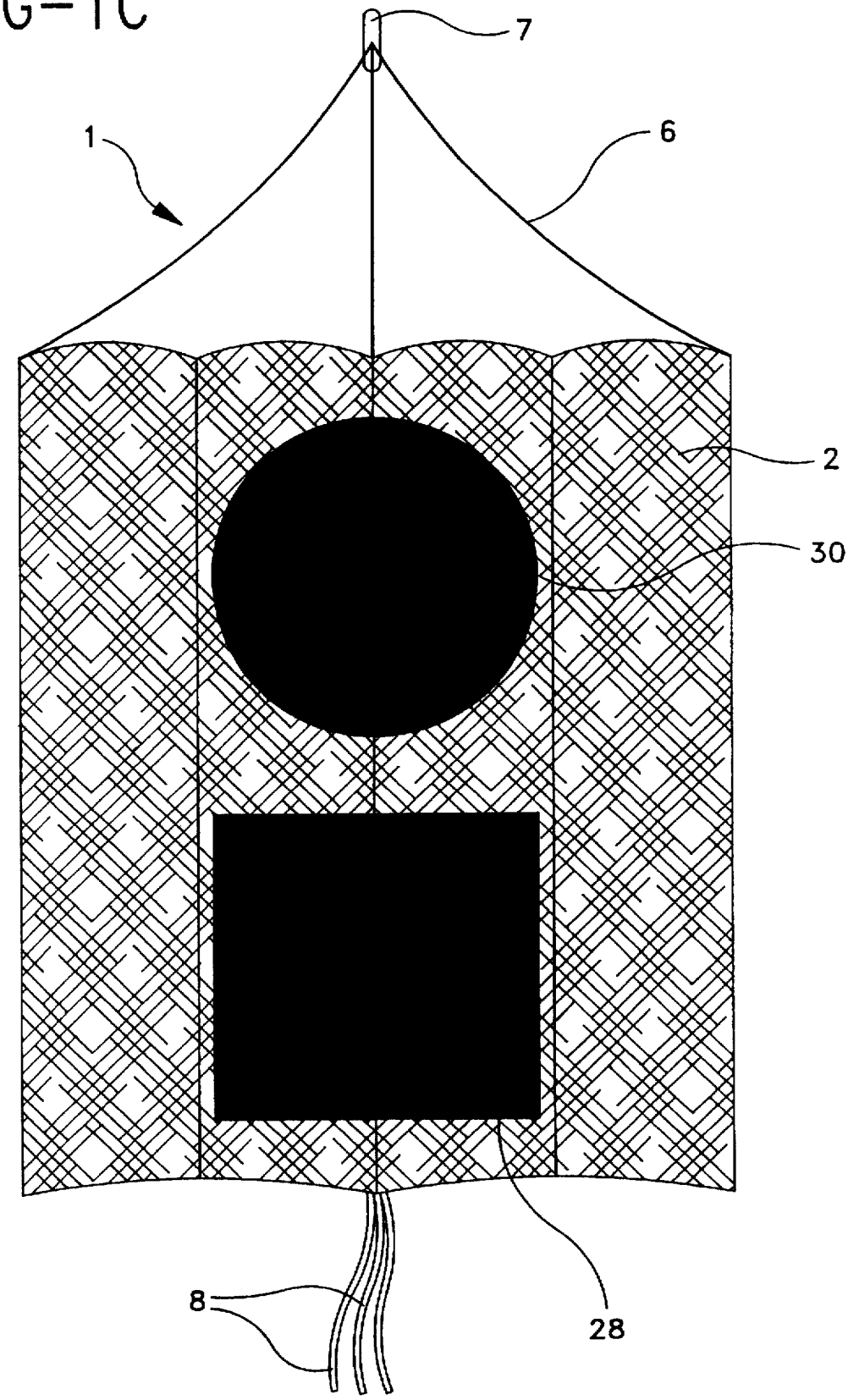

While a parafoil in white or color would itself have considerable visibility when flown at some altitude above the sea or land, the basis for the present invention is that the parafoil (at least) is colored International orange, preferably in its entirety, and carries a U.S. Coast Guard-approved distress signal consisting essentially of a black square (28) and circle (30), as shown in FIG. 1C. To be USCG-certified as a visual distress flag under 46 C.F.R. 160.072, the signal must be displayed on an orange field at least three feet square, but private communications from U.S. Coast Guard Headquarters staff to Applicant have indicated that parafoils slightly narrower than three feet across the canopy may rely upon the width of the side panels to augment that measurement. Such parafoils are a convenient size for portable distress signals.

Figure 2:
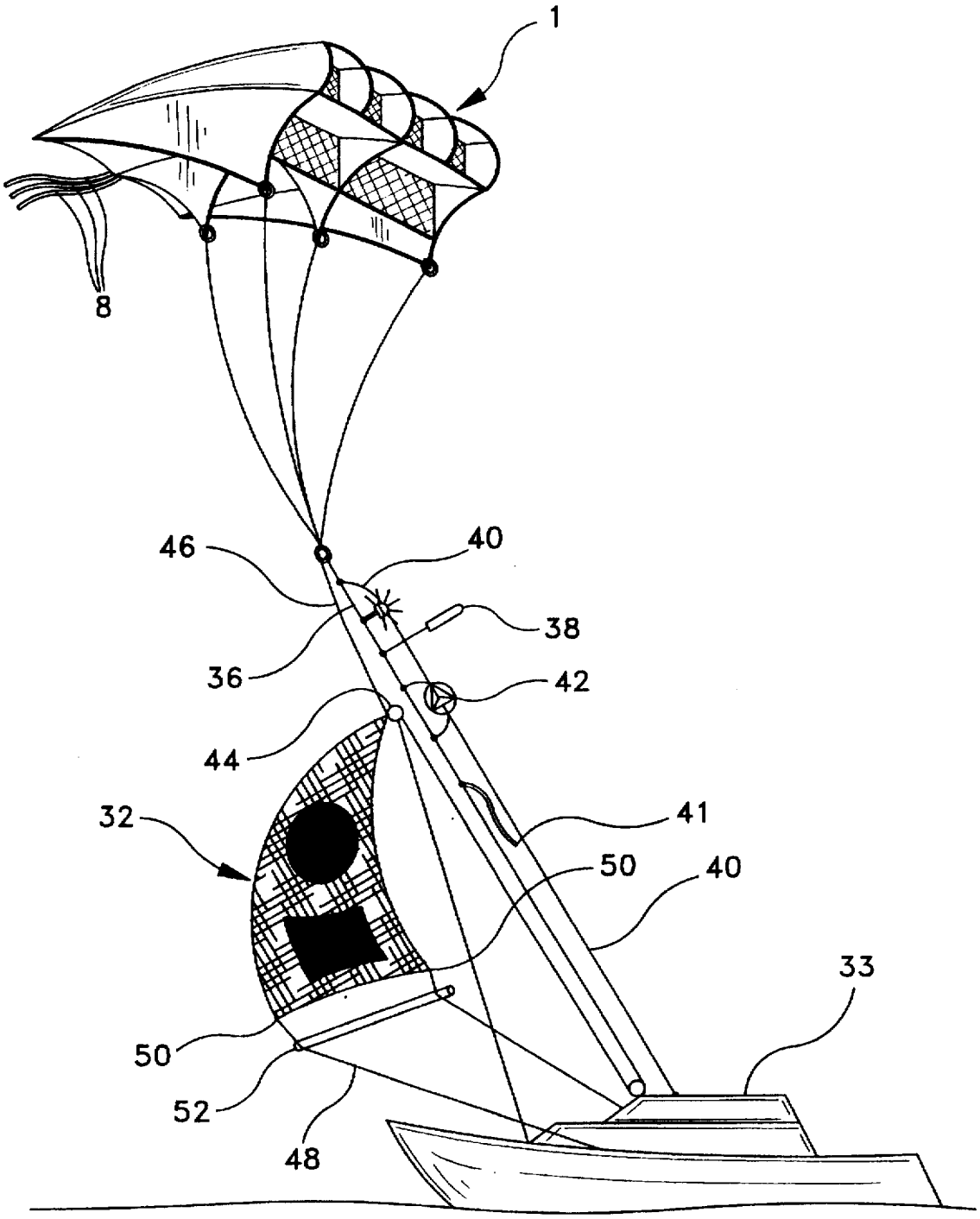
FIG. 2 illustrates several components of the distress signal kit of the invention in operation—a parafoil with radar reflective tail hoists a spinnaker sail (for propulsion) into the air from a vessel in distress. The parafoil, with or without the spinnaker, acts as a lifting device to carry various distress signals including strobe lights, flares, radio antennae and radar reflectors.

FIG. 2 illustrates embodiments of the invention wherein several components of the distress signal kit are in operation. The parafoil (1) with radar reflective tail (8) hoists spinnaker sail (32) into the air from a vessel (33) in distress. The parafoil and spinnaker in combination can carry multiple distress signals aloft, including battery-powered strobe lights (36), pyrotechnic flares (38), radio antenna (40), radar reflective strips (41) and radar reflectors (42). Various combinations of such distress signals may be used during day or night conditions. Both the parafoil and spinnaker sail include the USCG-approved distress signal (black square and circle) on both surfaces as shown, and are at least partially International orange in color. Due to its size and orientation, the spinnaker augments and complements the visible distress signal provided by the parafoil; the parafoil's distress flag is most easily seen from the air, while the spinnaker's flag, being more vertically disposed, is most easily seen from surface vessels or very low-flying aircraft.

The spinnaker sail is the spherical triangular shape (when filled with wind) well known to sailors. It is attached from the head (44) to a line (46) (or lines) from the parafoil, and is controlled by sheets (48) (lines to the uninitiated) attached to the two lower clews (50). Optional spreader bar (52) helps to spread the spinnaker. The spinnaker and parafoil are shown relatively close to the boat for convenience of scale, but would of course be flown at a suitable altitude to optimize the display of the distress flag and signals. In addition to providing a larger distress signal, such a sail can provide considerable propulsive power, which is also aided by increased altitude of the sail. Trimming and operation of such sails are described in Applicant's U.S. Pat. No. 4,497,272 and in a variety of sources on sailing. The spinnaker can be large and elaborate so as to provide effective controls and possible propulsion power for vessels in distress, or include only the essentials in a small package for convenient launching and operation by individual swimmers or survivors in liferafts or the like.

Figure 4:
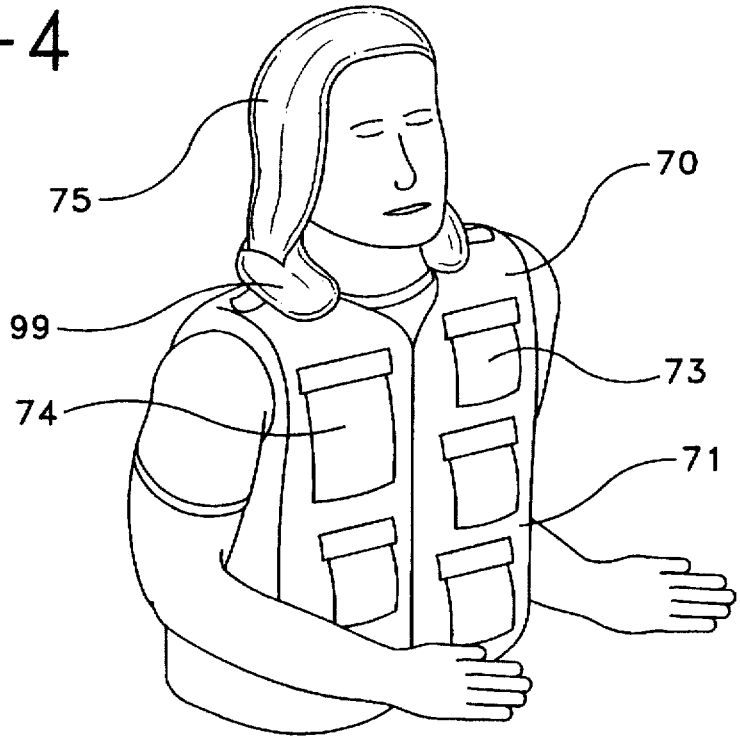
FIGS. 4, 4A and 4B illustrate a life jacket-distress signal kit having compartments to hold a parafoil, small spinnaker sail and survival hat, with the jacket also including a protective hood and radar reflective distress signal which can be stowed in the collar.
Figure 4A:
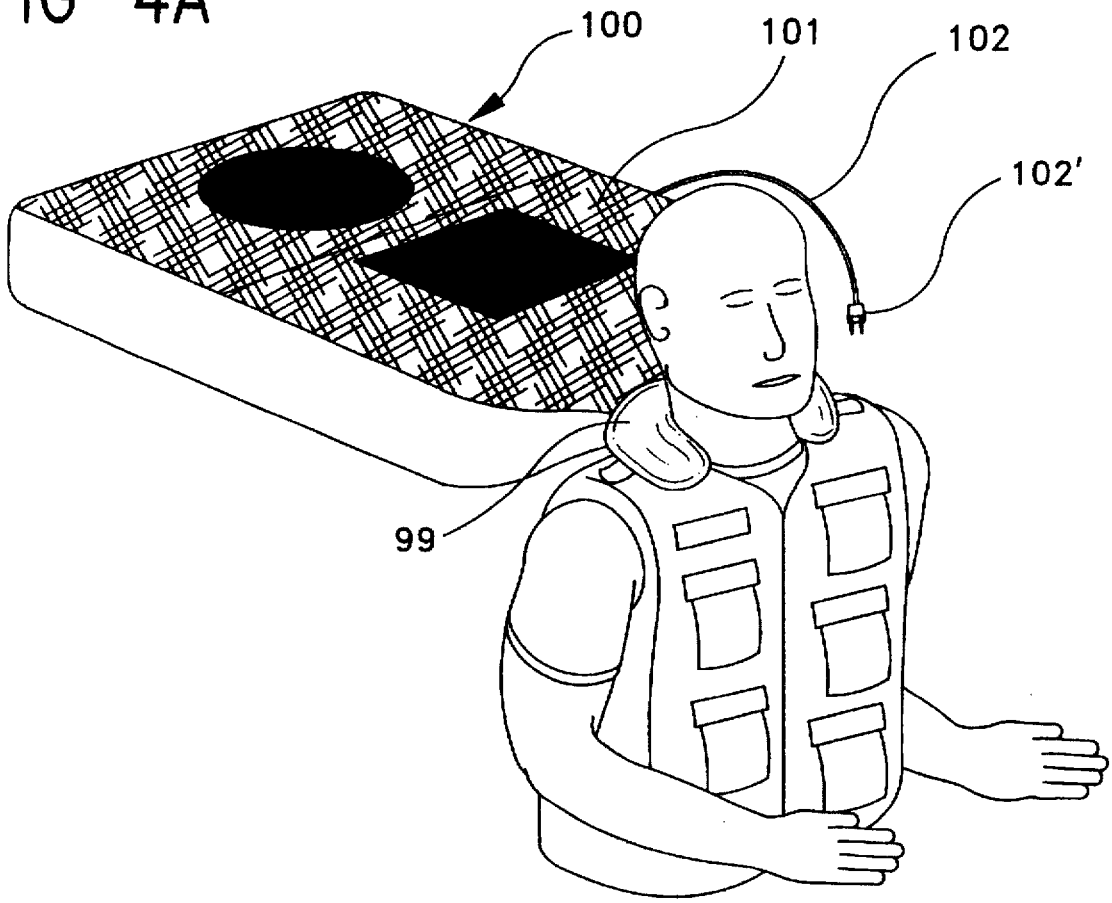

Battery-powered strobe lights are selected from commercial sources so as to be suitable for lifting by a given parafoil, with or without spinnaker sail, and are preferably designed for long storage life and marine use. The use of a strobe light, producing a bright flash at repetition rates ranging from about 20 to about 100, preferably from 50 to 70 times per minute per Inland Navigation Rules, produces optimum visibility and duration of signal for a given energy level (primarily represented by the weight of the battery). These strobe lights can be recharged by flexible solar cell material such as cited in Applicant's U.S. Pat. No. 4,553,037, which is incorporated herein by reference. This material can be part of any of the exposed surface materials of the kit, as shown in FIG. 4A. The pyrotechnic flares (or smokes) can be any of those authorized by the U.S. Coast Guard, and can be lighted before raising on the parafoil line to the selected height.

The radio antenna can be a simple insulated antenna wire attached to the parafoil line by simple clips, rings and shackles, or any suitable attachment means. Similarly, all the distress signal devices discussed can be attached to the parafoil and/or spinnaker lines by suitable mechanical attachment means. Various radar reflectors can be attached, such as the collapsible or foldable sets of three discs providing three orthogonal reflective surfaces when assembled (known and commercially available, such as, e.g. the "Davis emergency reflector"). Preferably, collapsible inflatable reflectors can be used, as described below.

Figure 2A:
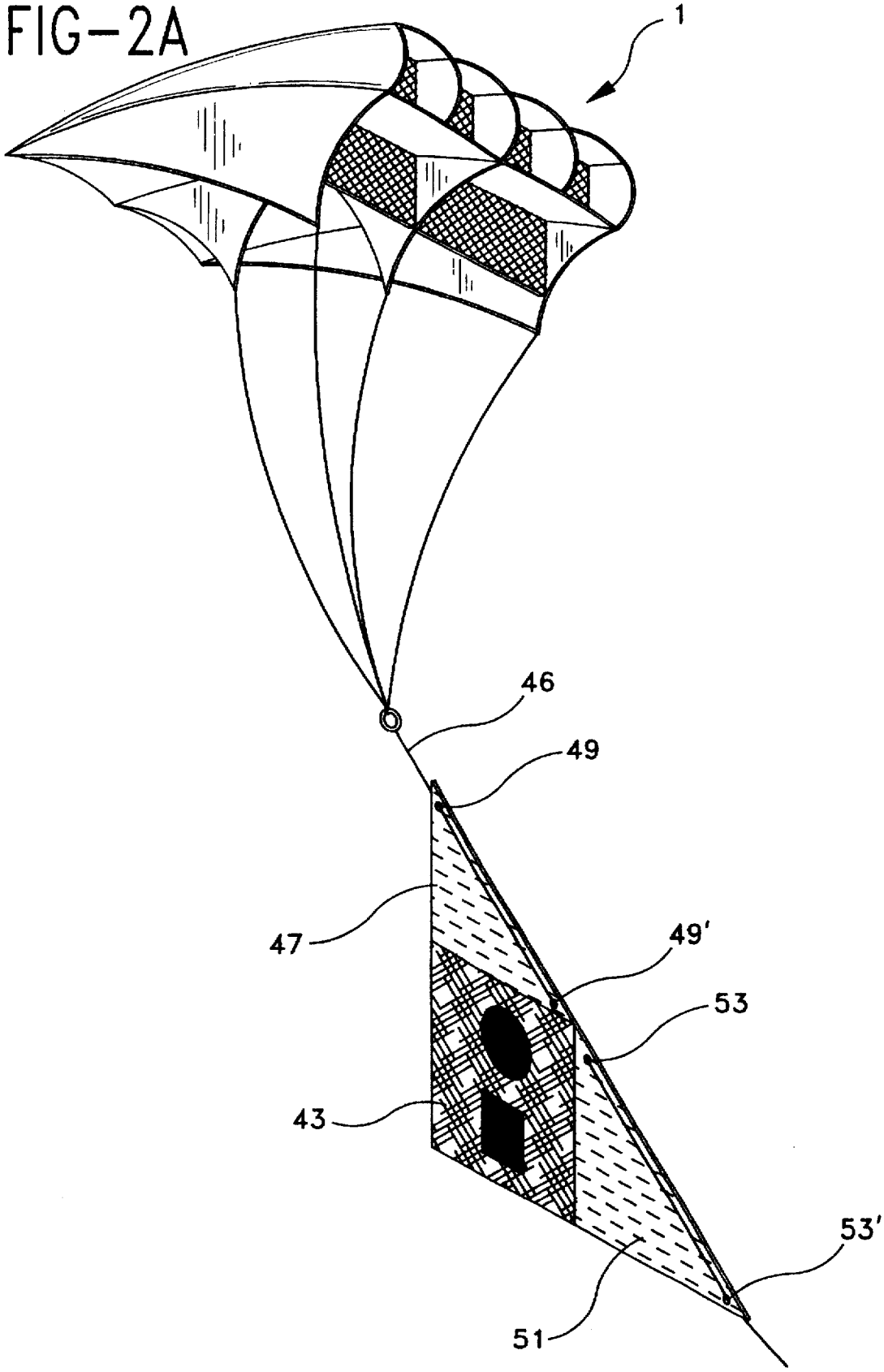
FIG. 2A illustrates an additional distress flag suspended from the parafoil line.

FIG. 2A illustrates an additional distress flag (43) suspended from the line (46) to the parafoil (and/or the spinnaker sail) by at least one triangular-shaped connector (47) of suitable fabric or plastic film attached to the top and/or vertical leading edge. (The expression and/or is used conventionally to mean either, or both, items.) The flag is preferably an authorized U.S. Coast Guard model (at least 36 inches square) with the square and circle shown on both sides in black against an International orange background. Radar reflective material can be included to provide additional radar targets, and the connector is preferably silver or white to optimize visibility by day or night. The line can be threaded through grommets (49) and (49') provided in the connector and secured so as to stretch the connector and flag and maintain the surfaces thereof as flat as possible, or can alternatively be attached to the connector by any suitable mechanical means.

As shown, the flag is suspended in position by one triangular connector (47) attached to the top edge and one triangular connector (51) attached to the vertical leading edge of the flag, with the parafoil line threaded through grommets (53) and (53') and fastened securely. The flag thus hangs in substantial alignment with the vertical from the parafoil or spinnaker line which describes an acute angle with the vertical or horizontal. Although the flag with single connector (47) can be rotated and reattached to the line so as to fly in horizontal position in light winds, preferably such a connector is used to hang the flag in a vertical position, with additional connector 51 used to provide additional security in heavy winds. In addition to providing an additional distress flag, an advantage of aligning the flag in this manner is that its surface will be substantially perpendicular to that of the parafoil as well as that of the spinnaker if used; thus these three display modes provide a visual distress signal from nearly any angle and are complementary.

Figure 3:
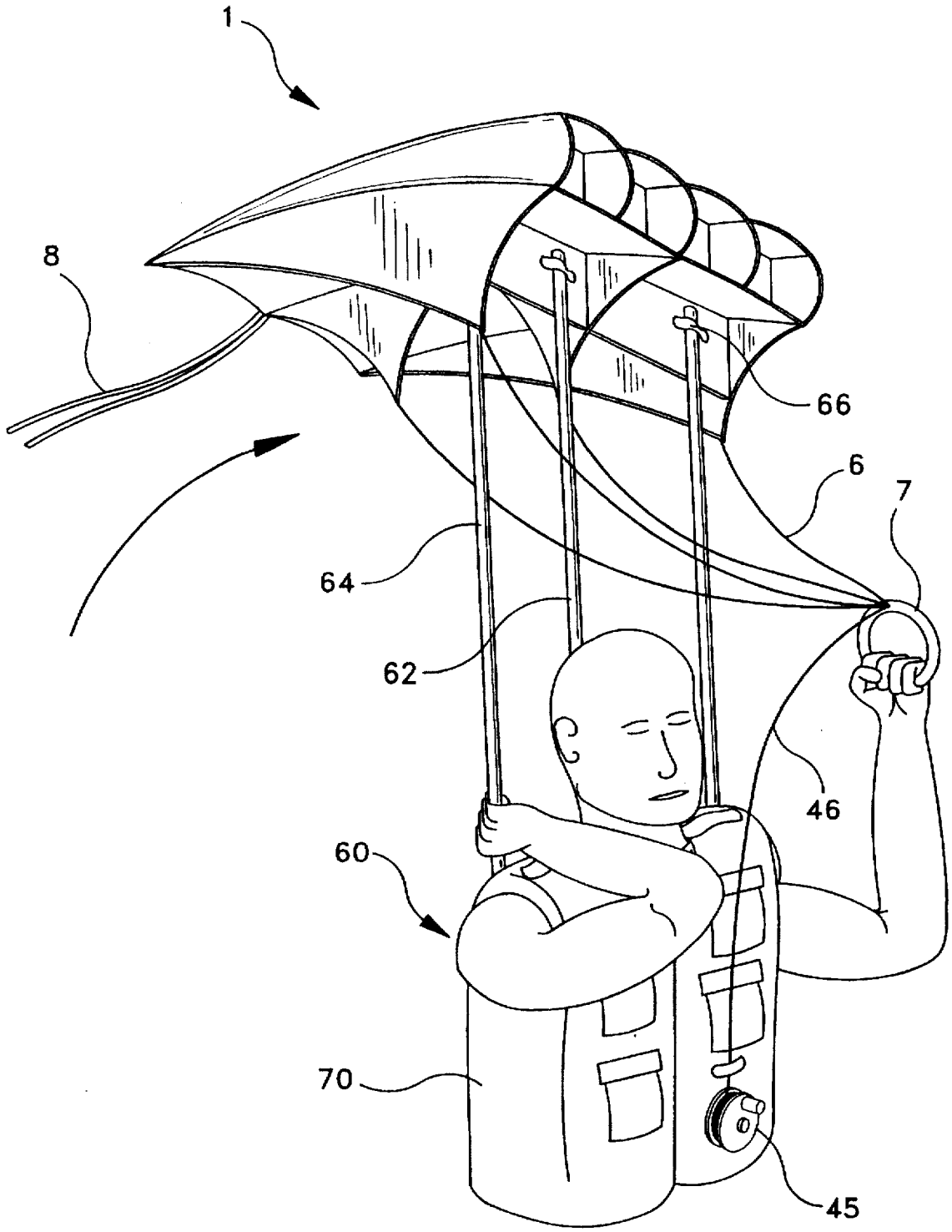
FIGS. 3 and 3A illustrate a swimmer in the water launching a small parafoil as an aerial distress signal.
Figure 3A:
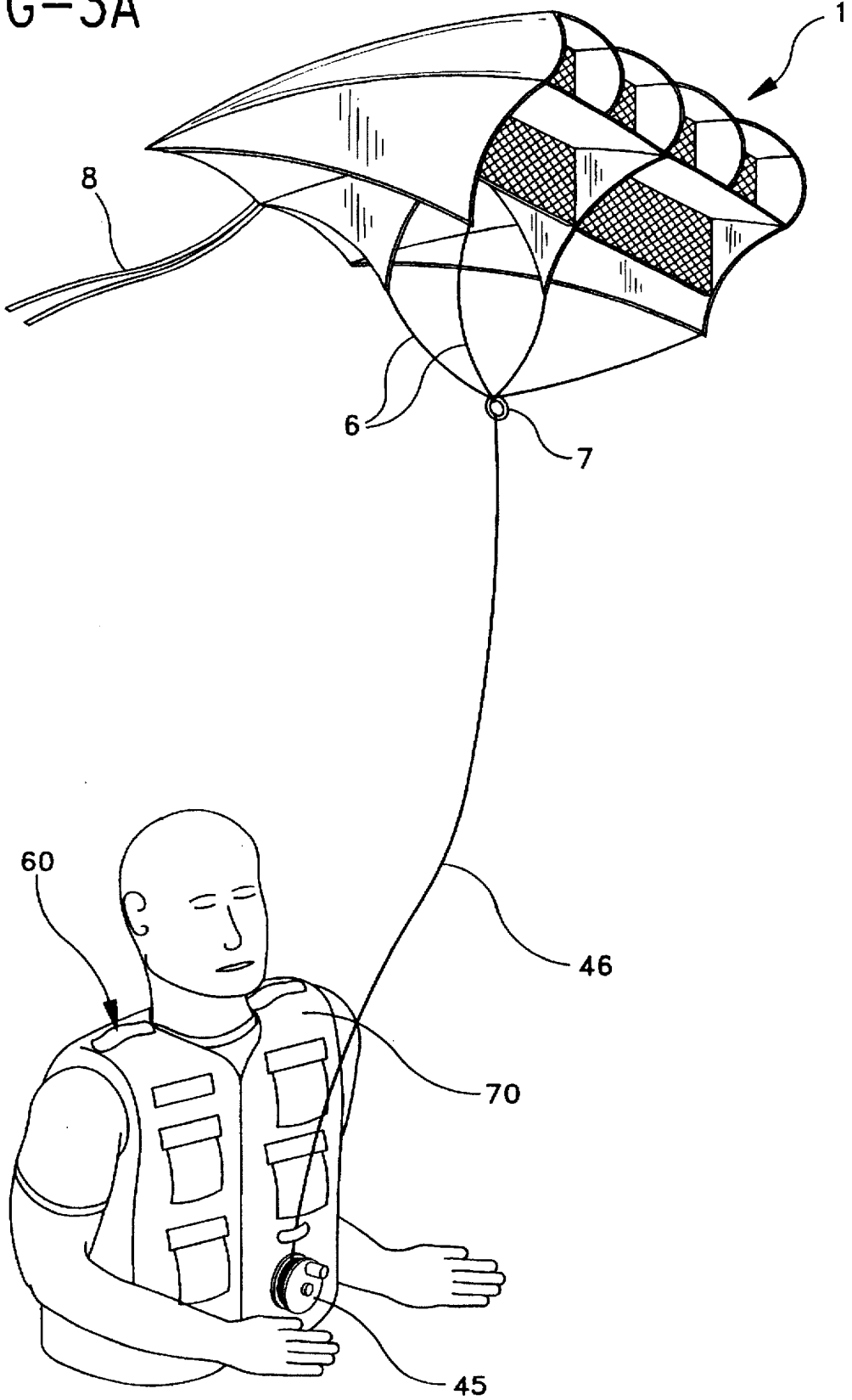

In FIG. 3, a swimmer (60) is shown in the water wearing a life jacket (70) or other suitable flotation device. The swimmer is about to launch a parafoil (1) with tail (8) as an aerial distress signal by hoisting it aloft on a collapsible rod (62) (in the center of the parafoil) or alternatively, two rods (64), one on each side, to allow it to catch the wind. The rods are attached to the parafoil by suitable detachable metal clips (66) or the like. Small parafoils can be easily launched on land or sea, or even from a lifejacket in the water, by attaching the bridle (6), line and tail (if used), then holding the forward corners up into the wind so that the cells inflate. The swimmer initially holds bridle (6), then line (46). The line is stored, dispensed from and retrieved with a suitable reel or spool such as (45), which also serves as a handle. The line is let out about 100 feet to allow the parafoil to gain altitude and catch stronger winds than exist at the surface (See FIG. 3A.); then suitable signal devices can be attached to the line and more line let out to carry them to the desired altitude. If such collapsible launching rods are not carried or not available, it has been demonstrated that a swimmer in life jacket can launch a parafoil of reasonable size (say, three feet square) by holding the parafoil by the bridle lines on each side and pulling it overhead in the air so as to catch the wind and inflate the cells. See the examples for more guidance on swimmer procedures for launching parafoils.

FIGS. 4, 4A and 4B and 5, 5A and 5B illustrate a life jacket-distress signal kit (70) having multiple pockets or compartments (73) to hold a parafoil, small spinnaker sail and survival hat, with the jacket also including a protective hood and radar reflective inflatable flag and flotation device which folds into the collar. The jacket (70) is preferably International orange in color. Sections (71) contain flotation material (72) (not shown), which can be solid but preferably comprises inflatable bladders with both pressure and manual inflation means (not shown). Large flap pocket (74) with suitable closure contains a packet which comprises a parafoil (1), bridle (6), line (46) and combination line reel/handle (45) inside a drawstring bag (78) which is also a survival hat. A lightweight hood (75) can be folded out of storage in the jacket collar (99) and is preferably International orange in color.

Figure 5:
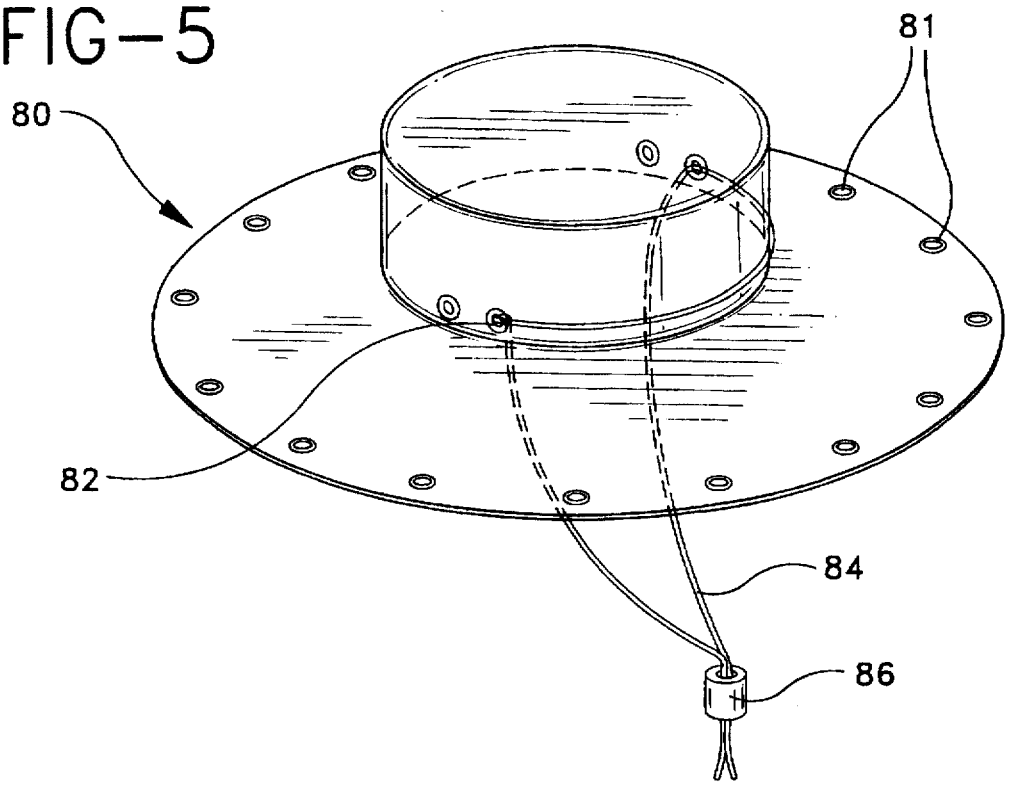
FIGS. 5, 5A and 5B illustrate a survival hat which is part of the life jacket-distress signal kit.
Figure 5A:
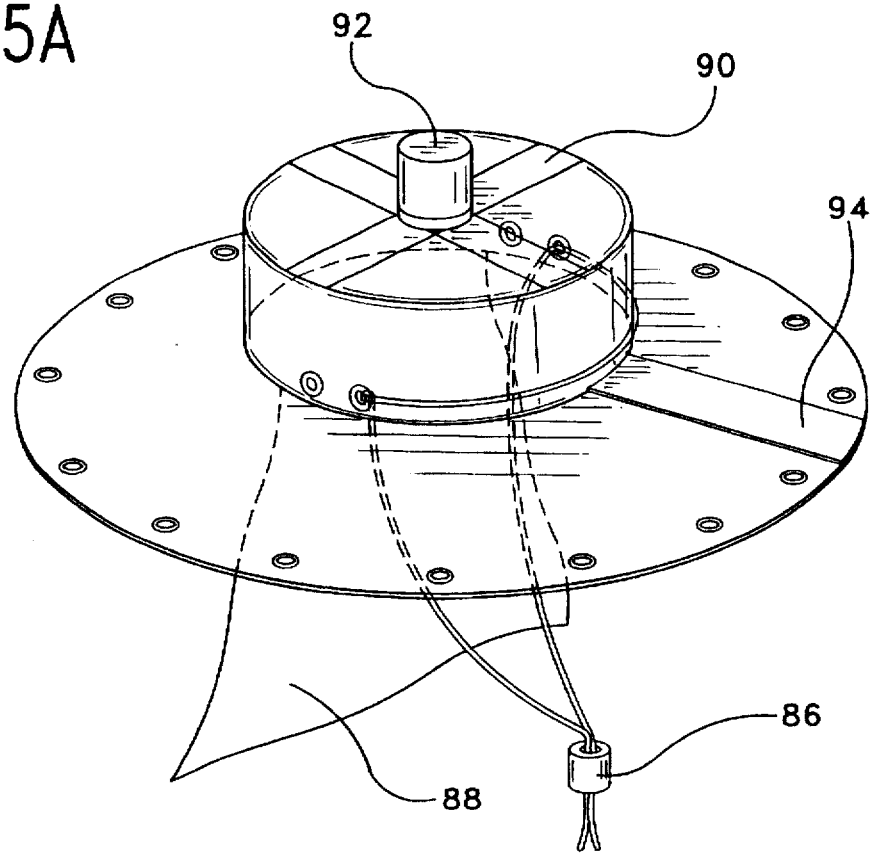
Figure 5B:
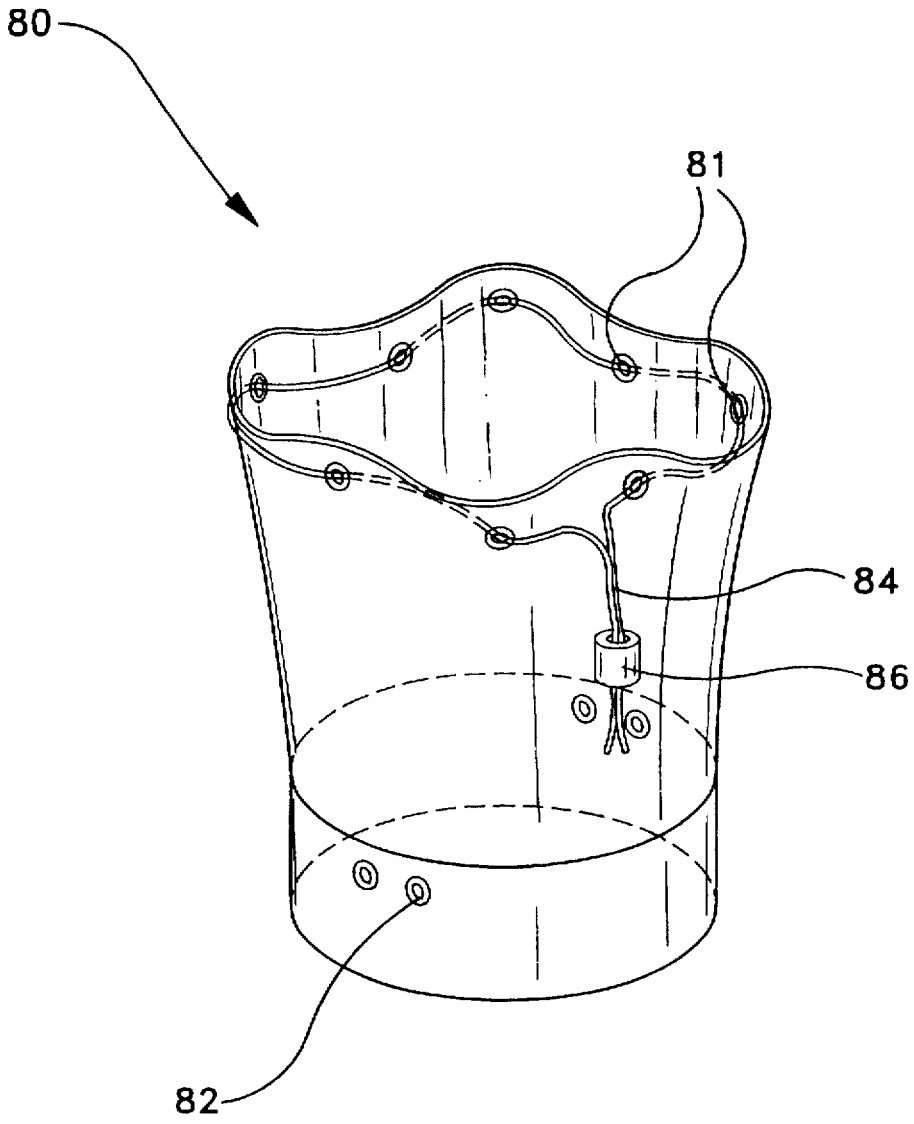

The hat (80) is shown in FIGS. 5, 5A and 5B, and includes grommets (81) in the brim to provide the drawstring bag feature. When the hat is in use the drawstring can be placed through vent holes (82) to form a chin strap (84) which can be fastened with clamp (86). The hat's broad brim keeps sun off the face and of course provides a sizable drawstring bag for storing the parafoil. Additionally, a survival hood (88) of light weight material is folded into the crown of the hat, but can be pulled out to protect the top of the shoulders, neck and face from the sun while expanding the area of International orange displayed as a distress signal. Velcro (90) and/or rings (not shown) for mechanical attachments on top of the hat provide a place to attach a strobe light (92) and/or small radar reflector (not shown here). Reflective tape (94) can be affixed to the hat and/or jacket to enhance visibility of the survivor, by day reflecting sun and by night reflecting searchlights, etc.

Figure 4B:
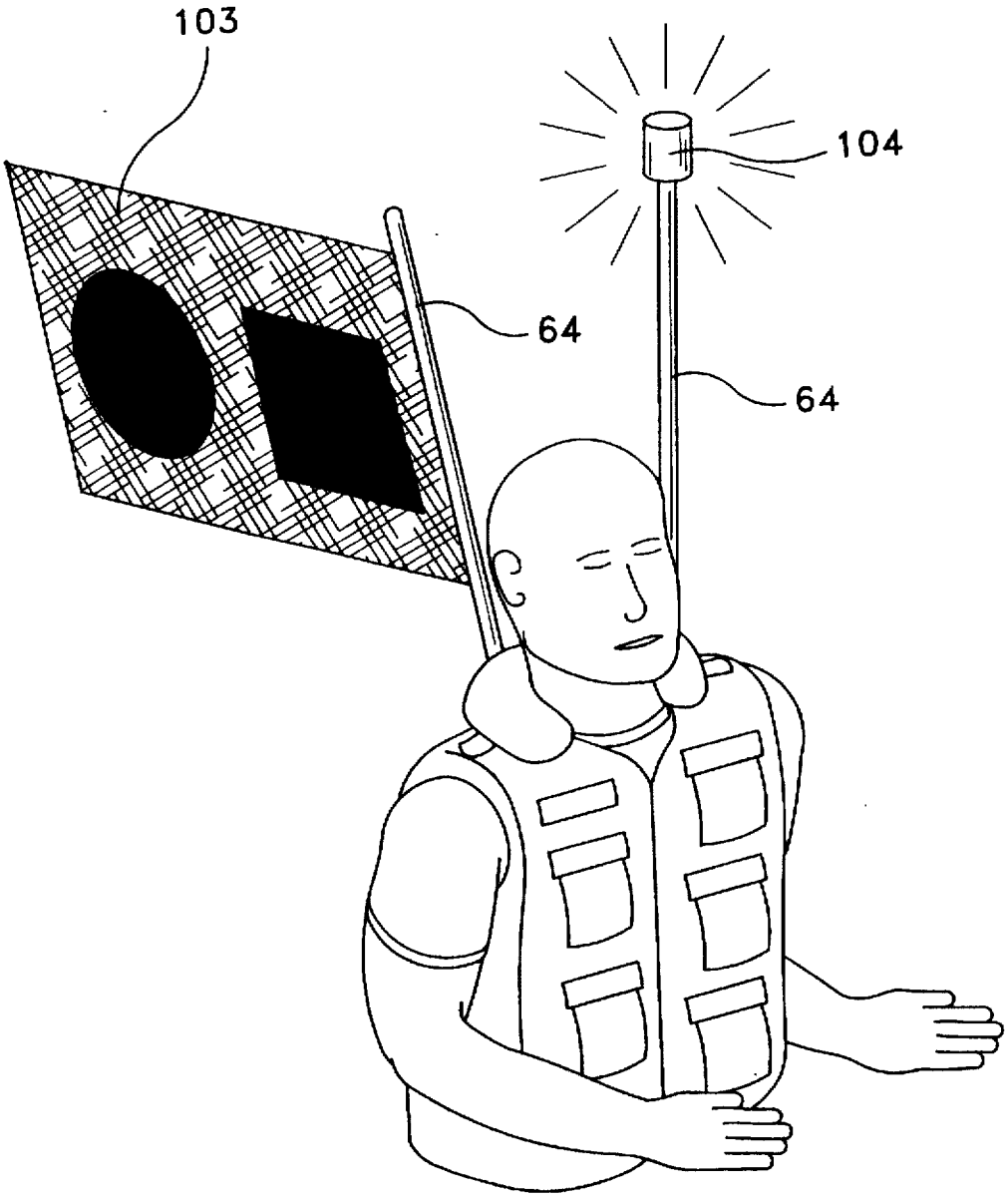

Jacket pockets (73) on the front contain various distress signals including flares, smoke signals, coiled radio antenna, folded or deflated radar reflectors or the like. A large pocket (98) on the back (not shown) contains at least one parafoil and a spinnaker sail (32) to be lifted by the parafoil and/or to provide for other survival needs. The rear of the jacket collar (99) contains an inflatable section of lightweight cloth or film (100) which can be folded out and inflated to float behind the survivor and display the distress signal of black square and circle on orange as shown. At least a suitable portion of the upper surface of this inflatable body can incorporate flexible solar material comprising photovoltaic cells or the like, shown in FIG. 4A as (101), with cord (102) and connector (102') provided to connect to a rechargeable strobelight such as shown in FIGS. 4B and 5A. Such flexible solar cells can be incorporated in the exposed surfaces of nearly any part of the kit, including, e.g. the hat, jacket and parafoil, where needed for recharging strobe lights or other units.

Pockets (105) in the jacket back contain foldable or collapsible rods (64) which can be used for launching the parafoil, mounting radio antennas or distress flags (103), holding a strobe light (104) above the water surface and a variety of uses.

Figure 6:
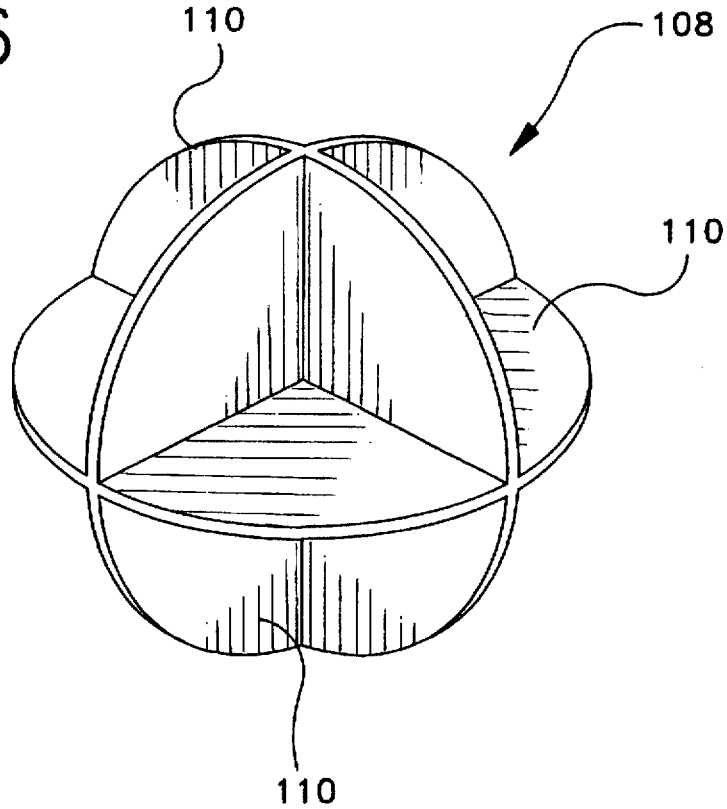
FIG. 6 shows a Davis radar reflector with orthogonal reflective surfaces.

FIG. 6 shows a folding orthogonal radar reflector (108) assembled. The three discs (110) of radar-reflective material interlock to form a set of three mutually orthogonal planes, all of them radar reflective. Such reflectors are commercially available in a variety of sizes, including, e.g. the Davis models for small boats. The result is to produce omnidirectional retroreflection of radar waves, as discussed above.

Figure 7:
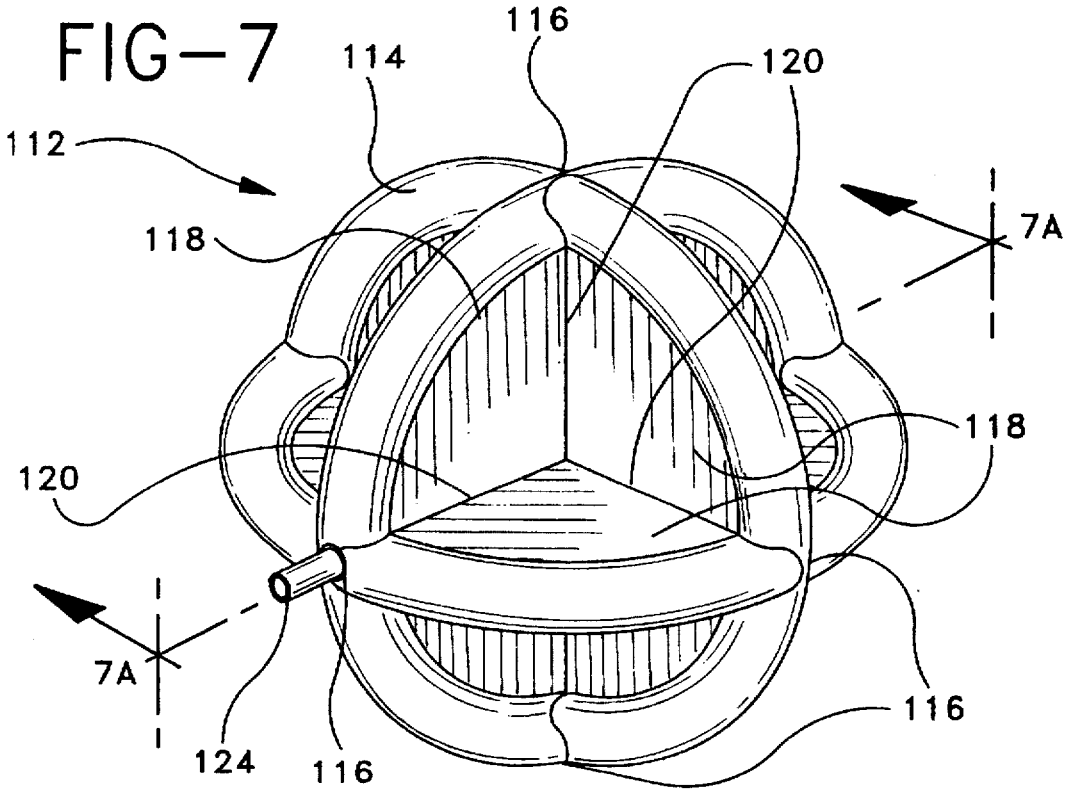
FIGS. 7 and 7A show Applicant's inflatable radar reflector which can be encased within a balloon.
Figure 7A:
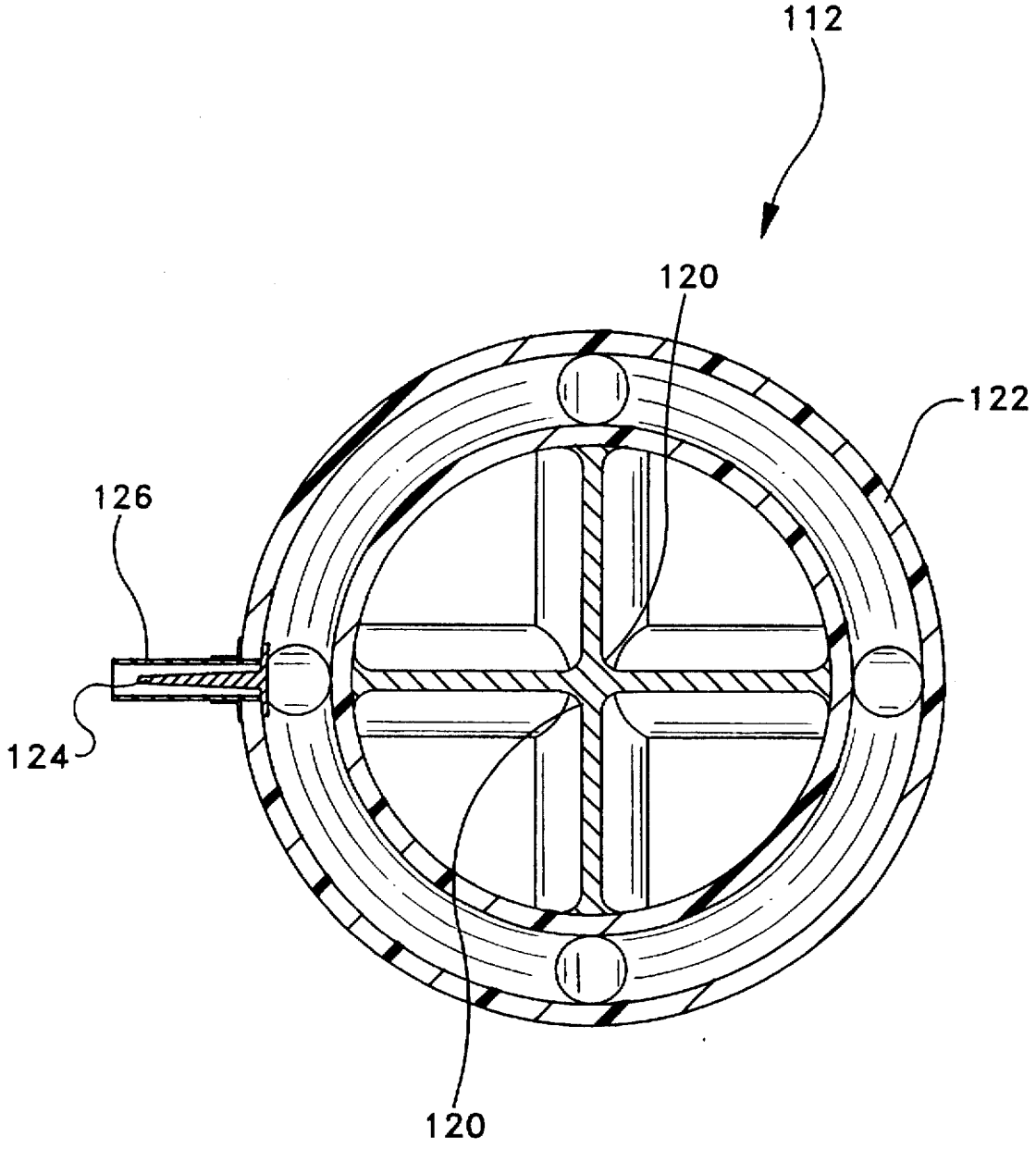

FIGS. 7 and 7A show Applicant's collapsible inflatable radar reflector (112), which also provides three mutually orthogonal reflecting surfaces. The three inflatable hoops (i.e., toruses) (114) are made of elastomeric tubing resembling the tubes for bicycle tires or the like and mutually intersect at points (116) so as to provide a single inflatable air reservoir, with the hoops held in orthogonal position. Thin discs (118) of flexible, radar-reflective material such as aluminized Mylar are fastened securely inside each hoop, mutually intersecting at lines (120) and configured so that the final assembly provides three orthogonal radar-reflective discs. Optionally, to provide protection from the elements and added rigidity for the inflated hoops, the device is encased in a large elastomeric, radar-permeable balloon (122), shown in cross-sectional view in FIG. 7A. The inflation tube (124) of the reflector is led out through the balloon inflation tube (126), so that the reflector unit and balloon may be inflated sequentially or essentially simultaneously. When both units are fully inflated and the inflation tubes secured, the hoops and orthogonal radar reflective surfaces are held firmly in place and protected from the elements. The unit can be collapsed and encased in an envelope or packet for storage in a lifejacket pocket, as described above. In conditions of calm or light winds, the unit's hoops and balloon can be at least partially inflated with a lighter-than-air gas such as helium or hydrogen, so that it is buoyant and does not require a lifting device such as the parafoil. Such gases can be provided by small cartridges, gas generators, or any available source.

Figure 8:
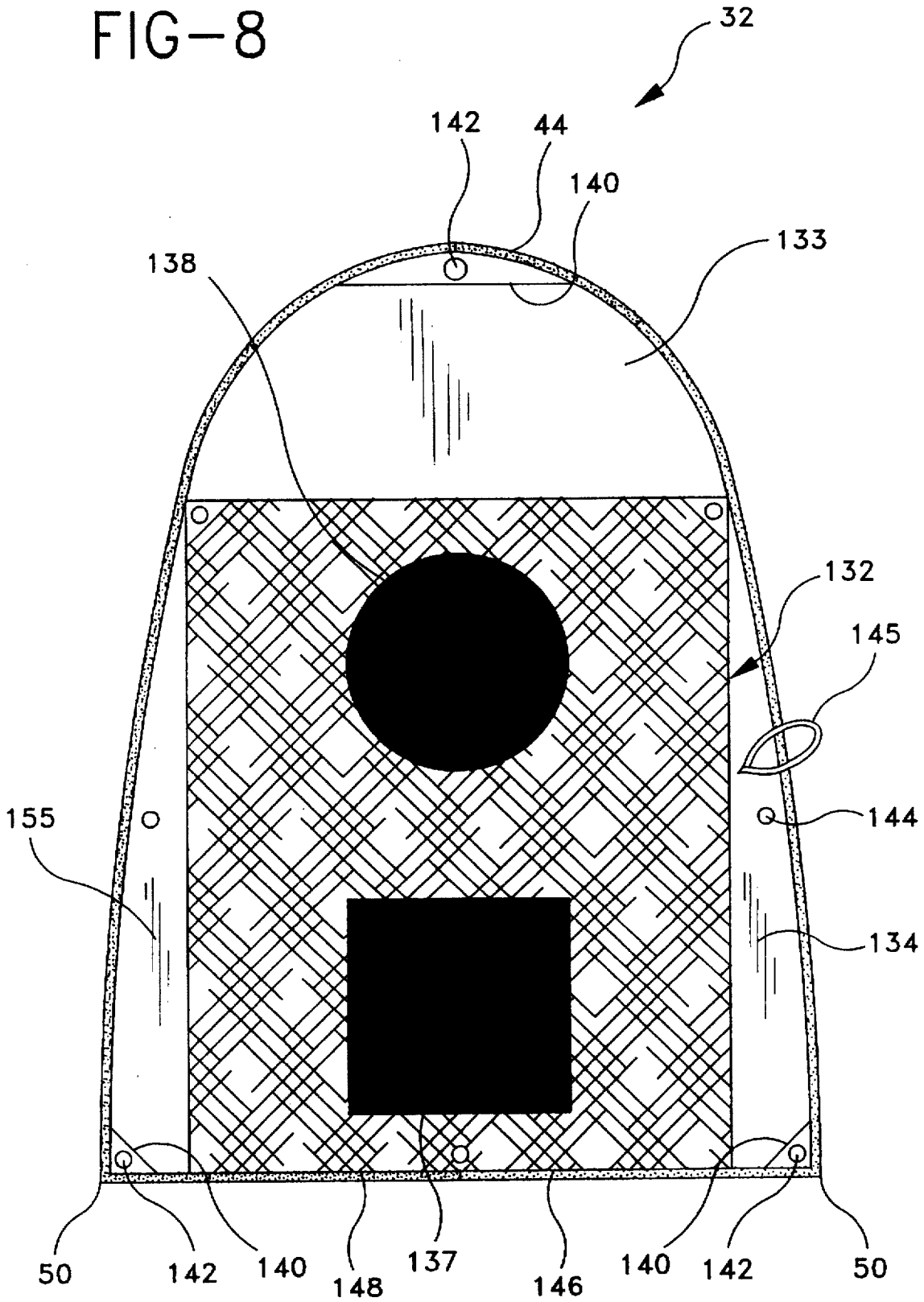
FIG. 8 shows a spinnaker sail incorporating a distress flag and other survival features.

FIG. 8 shows a spinnaker sail (32) incorporating an approved distress flag (132) and other survival features. The sail is sewn of four pieces (132), (133), (134) and (135) to achieve the generally spherical triangular shape desired when filled with wind. Substantially rectangular central portions (132) on each side of the sail at least three feet square are colored International orange and contain the black square (137) and circle (138) required for the USCG distress flag. (Due to the use of flat pieces of material to form a sail which has a spheroidal surface when filled with wind, it may be necessary to form this "rectangle" as a trapezoid, with the shorter of the two parallel sides at the top of the sail, nearest the head.) The portions of the sail surrounding this distress flag (133), (134) and (135) are colored silver or black to outline and emphasize the flag as required. If silver or other reflective colors are used, the spinnaker will be capable of reflecting light as well as displaying the orange and black distress flag. The corners of the sail, known as the head (44) and the clews (50), are reinforced (140) and grommmeted (142) for attachment of lines (or sheets) (not shown here). Grommets (144) and/or loops (145) are also placed at positions around the perimeter to aid in the use of the sail as a survival aid when not flown with the parafoil. The edges of the sail are covered with pile (146) or hook (148) Velcro(TM) to facilitate use of the sail as a rain cape, blanket, coat, sleeping bag or the like for use in survival situations. The sails can be made of any suitable material, but are preferably made of metallized fabric (such as polyester) or plastic (e.g., aluminized Mylar) to provide a light, durable distress flag and radar reflector. A preferred fabric comprises a fiber matrix in a polymer laminate.

In addition to serving as a large distress flag to augment that on the parafoil, the spinnaker can serve as a propulsive sail for a small boat, lifeboat or liferaft. The sail preferably includes a significant amount of radar-reflective material such as aluminized Mylar to make it a larger radar reflector than the parafoil (albeit not omnidirectional). The sail can be used as a spotlight reflector, a rain catcher (for drinking water), a rain cape, shelter half, ground cover or sleeping bag. The sail can also serve as a, tent or teepee. By creative use of the grommets, connecting means such as rope or line and the velcro sections provided, all these alternate uses can be made of the sail in various survival situations.

It should be apparent from the above descriptions that the present invention provides integrated systems of parafoil-borne distress signals which can be used in a variety of contexts from individual use to vessels large or small. Marine applications are particularly noteworthy. Individual swimmers or survivors can be provided with a life jacket containing a survival hat, at least one parafoil, distress signal devices, spinnaker sail and launching/control equipment enabling a survivor in the water with lifejacket to signal his presence by night or day. Small versions of such kits can be carried by hikers or mountain climbers. Larger, more extensive sets of devices can be assembled for use in automotive vehicles, aircraft, boats or vessels of various sizes. The parafoils an /or spinnaker sails can provide propulsion to boats or vessels of almost any size, and the parafoils can serve as sea anchors when required. In addition to providing daytime distress flags, these kits can provide for night distress signals by hoisting aloft pyrotechnic signals, strobe lights or the like. By designing certain components to serve as packaging for the kits and as survival gear as well, a maximum of benefits are obtained from a relatively small package of emergency gear and distress signals.

EXAMPLES

The invention will be further illustrated by the following nonlimiting examples.

The research upon which Applicant's U.S. Pat. No. 4,497,272 was based has demonstrated that parafoils and spinnaker sails of various sizes can be used together to attain considerable altitude and provide propulsion to boats as large as a 36 foot U.S. Navy Minesweeping Launch (displacing 28,000 pounds), as well as a 24 foot houseboat and a 32 foot sailboat.

Parafoils measuring three feet long by 28" wide (not including side panels) have been tested by swimmers in life jackets to demonstrate that they can be successfully launched in light winds even without launching sticks or other aids. In winds less than six knots, such a parafoil can be inflated and allowed to float on the water as a highly visible flotation aid for the survivor(s). In higher winds, such parafoils can serve as an effective sea anchor for survivors in lifejackets or life rafts. When the time comes to launch and fly the parafoil, even in a completely watersoaked condition it can be drained and held aloft in the wind to inflate the cells. When held aloft so that the trailing edge clears the water, any remaining excess water drips off the parafoil in the wind, reducing its weight. Then, a tug to windward by the swimmer/launcher will increase the relative wind and lift the parafoil higher above the water's surface. Continued "pumping" of the parafoil line helps to increase its altitude in light winds, and since wind increases with altitude, once a modest height is achieved the parafoil will rise easily as the line is let out —"as easy as flying a kite".

Spinnaker sails measuring about eight feet maximum length and configured as shown in FIG. 9 have been tested by laypersons and shown to be effective as rain capes, sleeping bags and the like in addition to their basic functions of distress signalling and propulsion.

Various at-sea tests of these parafoil-borne distress signals were conducted with the assistance of a U.S. Coast Guard 41 foot Rescue Boat. With the parafoil and various radar target materials operating at approximately 50 feet altitude, an aluminized Mylar spinnaker, strips of aluminized Mylar strips attached to the parafoil line and a Davis radar reflector about 12 inches in diameter similarly attached were detected by the Rescue Boat radar at 2.7, 2.7 and 2.9 nautical miles, respectively.

Clearly many modifications and variations of the present invention are possible in view of the above teachings. It is therefore to be understood that the scope of the invention is limited only by the appended claims.

I claim:

1. A life jacket and aerial distress signal kit comprising a buoyant life jacket having a collar and sufficient compartments adapted for holding distress signal components comprising at least one parafoil with bridle and line for flying same plus at least one collapsible rod for launching said parafoil, and a plurality of distress signal devices, a survival hood and a radar reflective distress flag which can be stowed in said collar.

2. The life jacket-distress signal kit of claim 1 wherein said distress signal devices are selected from the group consisting of radar reflective strips, battery-powered strobe lights, flares and smoke signals.

3. The life jacket-distress signal kit of claim 1 wherein said parafoil has a radar reflective tail.

4. The life jacket-distress signal kit of claim 1 wherein said distress signal devices comprise a collapsible omnidirectional radar reflector having three orthogonal reflecting surfaces.

5. A life jacket and aerial distress signal kit comprising a buoyant life jacket having a collar and sufficient compartments adapted for holding distress signal components comprising at least one parafoil with bridle and line for flying same and a plurality of distress signal devices, a survival hood and a radar reflective distress flag which can be stowed in said collar, wherein said distress signal devices comprise a collapsible omnidirectional radar reflector having three orthogonal reflecting surfaces, and wherein said radar reflector is enclosed within an inflatable radar-permeable balloon.

6. A life jacket and aerial distress signal kit comprising a buoyant life jacket having a collar and sufficient compartments adapted for holding distress signal components comprising at least one parafoil with bridle and line for flying same and a plurality of distress signal devices, a survival hood and a radar reflective distress flag which can be stowed in said collar, which kit further comprises a small spinnaker sail comprising radar reflective material and fitted with suitable connections for attachment to the line for flying said parafoil and for control of said spinnaker.

7. The life jacket-distress signal kit of claim 6 wherein said spinnaker contains on each side an essentially rectangular orange distress flag with a distress signal consisting essentially of a black square and adjacent circle.

8. A life jacket and aerial distress signal kit comprising a buoyant life jacket having a collar and sufficient compartments adapted for holding distress signal components comprising at least one parafoil with bridle and line for flying same and a plurality of distress signal devices, a survival hood and a radar reflective distress flag which can be stowed in said collar, wherein said parafoil is contained in folded form within a survival hat which forms a drawstring bag for storage of said parafoil within said life jacket.

9. The life jacket-distress signal kit of claim 8 wherein said hat comprises fastening means for affixing at least one of a strobe light and a radar reflector on top, a chin strap and folding means to cover at least a portion of the wearer's neck, face and shoulders.

10. A life jacket and aerial distress signal kit comprising a buoyant life jacket having a collar and sufficient compartments adapted for holding distress signal components comprising at least one parafoil with bridle and line for flying same and a plurality of distress signal devices, a survival hood and a radar reflective distress flag which can be stowed in said collar, wherein said lifejacket collar contains a folding, inflatable and detachable distress flag, orange in color and fabricated of a radar reflective material, having a distress signal of a black square and adjacent circle thereon, arranged to float in the water in use.

11. The life jacket-distress signal kit of claim 1 wherein said life jacket is inflatable.

12. The life jacket-distress signal kit of claim 1 wherein said compartments form pockets.

13. The life jacket-distress signal kit of claim 5 which further comprises means for inflating at least one of said reflector and said balloon with a lighter-than-air gas.

14. The life jacket-distress signal kit of claim 10 wherein the upper surface of said inflatable flag further comprises flexible solar cell material and connectors adapted for the recharging of at least one of rechargeable strobe lights or emergency radio beacons.

15. A life jacket and aerial distress signal kit comprising a buoyant life jacket having a collar and sufficient compartments adapted for holding distress signal components comprising at least one parafoil with bridle and line for flying same and plurality of distress signal devices, a survival hood and a radar reflective distress flag which can be stowed in said collar, wherein said parafoil incorporates an omnidirectional radar reflector having three orthogonal surfaces, and wherein said radar reflector is incorporated in the structure of said parafoil.

16. The life jacket-distress signal kit of claim 1 wherein said parafoil is colored orange and contains a distress signal consisting essentially of a black square and adjacent black circle on the top and bottom surfaces thereof.

* * * * *